US006779312B2

(12) United States Patent
Wright

(10) Patent No.: US 6,779,312 B2
(45) Date of Patent: Aug. 24, 2004

(54) ANCHORING DEVICE

(75) Inventor: William James Wright, Lesmurdie (AU)

(73) Assignee: Reinforced Concrete Pipes PTY LTD, Bibra Lake (AU)

( * ) Notice: Subject to any disclaimer, the term of this patent is extended or adjusted under 35 U.S.C. 154(b) by 0 days.

(21) Appl. No.: 10/195,465

(22) Filed: Jul. 16, 2002

(65) Prior Publication Data

US 2004/0010984 A1 Jan. 22, 2004

(51) Int. Cl.[7] ..... E04D 35/00; E04G 21/14; E04H 12/34

(52) U.S. Cl. ..... 52/125.5; 52/125.4; 52/125.3; 52/125.2

(58) Field of Search ..... 52/125.4, 125.5, 52/125.2, 125.3

(56) References Cited

U.S. PATENT DOCUMENTS

| | | | | | |
|---|---|---|---|---|---|
| 4,000,591 | A | * | 1/1977 | Courtois | 52/689 |
| 4,097,947 | A | | 7/1978 | Kiefer | |
| 4,367,892 | A | | 1/1983 | Holt | |
| 4,580,378 | A | | 4/1986 | Kelly et al. | |
| 4,930,269 | A | | 6/1990 | Kelly et al. | |
| 5,004,208 | A | | 4/1991 | Domizio | |
| 5,596,846 | A | | 1/1997 | Kelly | |
| 5,857,296 | A | * | 1/1999 | Niday et al. | 52/125.1 |
| 6,279,274 | B1 | * | 8/2001 | Amiet et al. | 52/125.2 |
| 6,341,452 | B1 | * | 1/2002 | Bollinghaus | 52/125.5 |
| 2001/0004824 | A1 | * | 6/2001 | Hazama | |

* cited by examiner

*Primary Examiner*—Carl D. Friedman
*Assistant Examiner*—Nahid Amiri

(57) ABSTRACT

An anchoring device adapted to be partially buried in a concrete member during forming thereof for cooperation with a pick-up unit, the anchoring device comprising an integrally formed lifting pin and a void former.

11 Claims, 3 Drawing Sheets

ANCHORING DEVICE

FIELD OF THE INVENTION

The present invention relates to an anchoring device. More particularly, the anchoring device of the present invention is intended for use in securing a lifting pin to a concrete member in order to facilitate the lifting and moving thereof.

BACKGROUND ART

Anchoring devices for the lifting and moving of concrete members generally comprise an anchoring portion which is embedded within the concrete member and a connecting portion which protrudes from the surface of the concrete. The connecting portion is generally recessed within a void in the concrete surface such that the end of the connecting portion does not protrude beyond the plane of the surface of the concrete member. The connecting portion is constructed so as to releasably attach to a "pick-up unit" allowing the concrete member to be moved. Generally more than one anchoring device is used when lifting or moving a concrete member.

A variety of anchors have been used previously in an effort to prevent pull-out during use. These include transverse pins (U.S. Pat. No. 4,580,378), T-(U.S. Pat. No. 4,367,892), V-shaped anchors (U.S. Pat. No. 4,930,269) or additional shear bars (U.S. Pat. No. 4,087,947) and plates (U.S. Pat. No. 5,596,846) to distribute shear stress.

Typical methods involve the use of one of a number of different recess formers that are required to hold the lifting pin in the appropriate recessed position during concrete casting. Recess or void formers of this type need to be removed from the concrete member after the concrete has set.

A further disadvantage with the prior art is the necessity to install the recess former in the concrete whilst such is still wet (U.S. Pat. No. 5,004,208). This process is inconvenient and time consuming. Further, the need to remove the recess former after the concrete has hardened is again time consuming.

The present invention has as one object thereof to overcome substantially, or to at least provide a useful alternative to, the abovementioned problems associated with the prior art.

The preceding discussion of the prior art is intended to facilitate an understanding of the present invention only. It should be appreciated that the discussion is not an acknowledgement or admission that any of the material referred to was part of the common general knowledge in Australia as at the priority date of the application.

Throughout the specification, unless the context requires otherwise, the word "comprise" or variations such as "comprises" or "comprising", will be understood to imply the inclusion of a stated integer or group of integers but not the exclusion of any other integer or group of integers.

The present invention provides an anchoring device and a system used to secure an anchoring device embedded within a concrete member. The void former is integrally moulded about the lifting pin. The void former has attachment arms with slots. The slots comprise enlarged terminal portions offset therefrom to suit a range of reinforcement bar/mesh diameters.

Attachment of the anchoring device to the reinforcing bar/mesh distributes shear stress forces into the reinforcing bar/mesh and away from the concrete as well as serving as an anchor member for lifting and thereby preventing the lifting pin from being pulled out of the concrete member.

DISCLOSURE OF THE INVENTION

In accordance with the present invention there is provided an anchoring device adapted to be partially buried in a concrete member during forming thereof for cooperation with a pick-up unit, the anchoring device comprising an integrally formed lifting pin and a void former.

Preferably, the void former is integrally moulded about the lifting pin.

Preferably, the void former is a substantially hemispherical member having a concave inner surface and a convex outer surface. The concave inner surface defines a substantially hollow void.

Preferably, a plurality of attachment arms extend from the convex outer surface of the void former. The attachment arms preferably comprise slots at their terminal ends, the slots comprising enlarged terminal portions offset therefrom.

Preferably, the lifting pin comprises an elongate bar having an enlarged foot, the enlarged foot being adapted to be buried in a concrete member. The lifting pin further comprises an enlarged head, the enlarged head projecting into the void formed in the concrete member by the void former.

The void former is preferably integrally positioned about the elongate bar of the lifting pin at a position such that the enlarged head of the lifting pin is positioned inside the concave portion of the void former such that the head of the lifting pin does not protrude out of the void formed by the void former.

Preferably, the elongate bar between the convex face of the void former and the enlarged foot of the lifting pin is substantially covered by a sleeve. The sleeve is preferably integral to the void former.

The terminal portions of the slots of the attachment arms are preferably adapted to engage reinforcing bar means provided in the concrete member.

Preferably, a plurality of anchoring devices may be provided in the concrete member.

BRIEF DESCRIPTION OF THE DRAWINGS

The present invention will now be described, by way of example only, with reference to one embodiment thereof and the accompanying drawings, in which.

BEST MODE(S) FOR CARRYING OUT THE INVENTION

Figure 1:
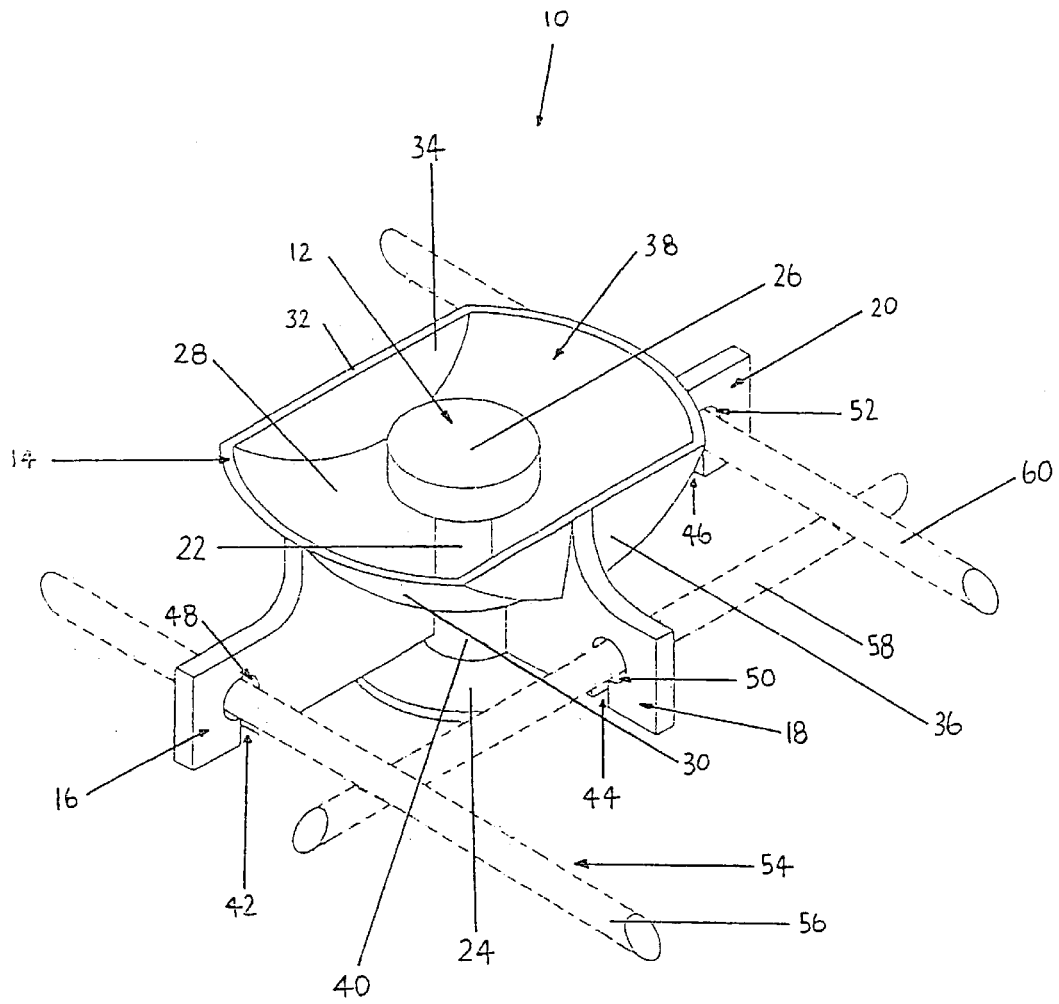
FIG. 1 is an upper perspective view of an anchoring device in accordance with the present invention, shown attached to a section of mesh reinforcing.
Figure 2:
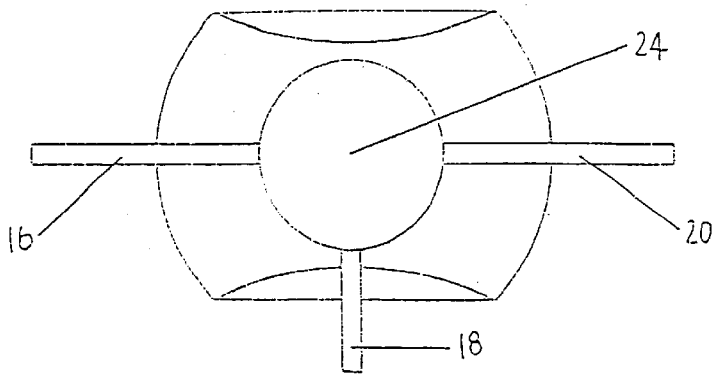
FIG. 2 is bottom plan view of the anchoring device of FIG. 1.
Figure 3:
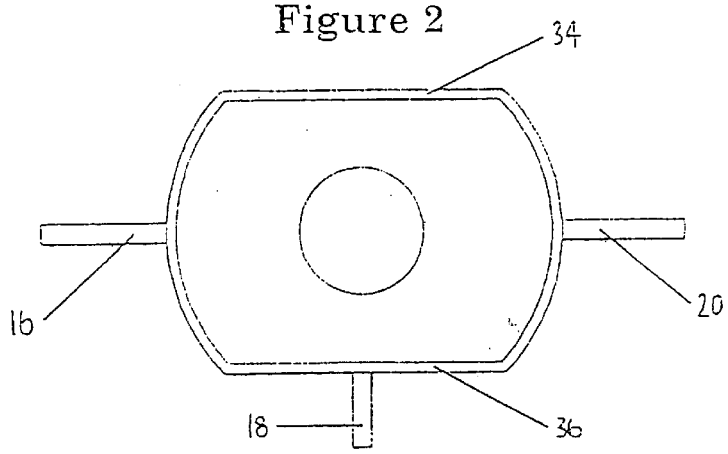
FIG. 3 is a top plan view of the anchoring device of FIG. 1.
Figure 4:
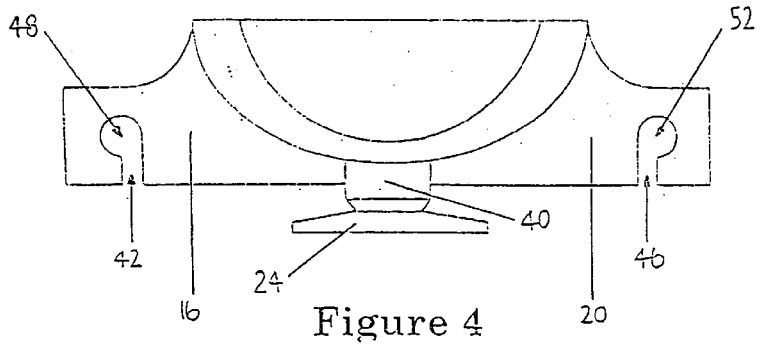
FIG. 4 is a first side view of the anchoring device of FIG. 1.
Figure 5:
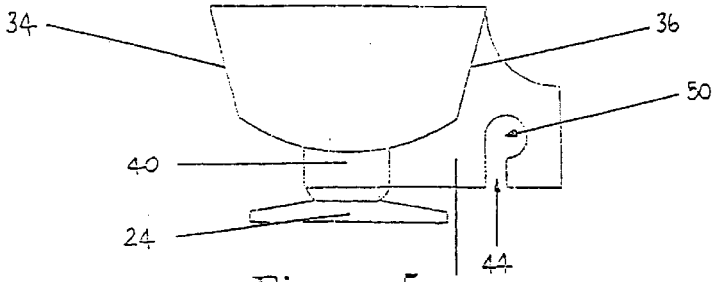
FIG. 5 is a second side view of the anchoring device of FIG. 1.
Figure 6:
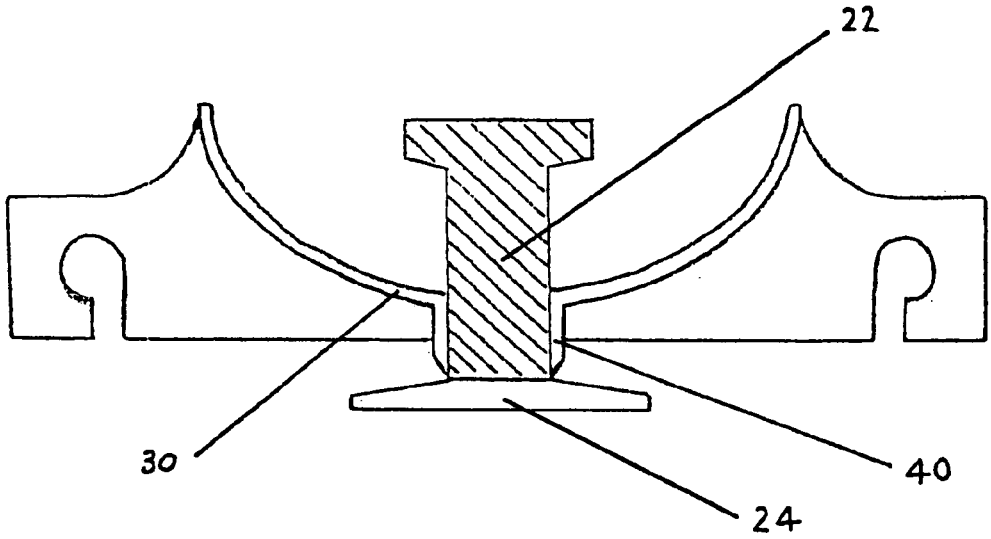
FIG. 6 is a cross-sectional side view of the anchoring device of FIG. 1.

In FIGS. 1 to 6 there is shown an anchoring device 10 comprising a lifting pin 12, a void former 14 and three attachment arms 16, 18 and 20 extending therefrom in divergent directions. The arms 16, 18 and 20, and the void former 14, are integrally formed.

The lifting pin 12 comprises an elongate bar 22, having an enlarged foot 24 and an enlarged head 26. The void former 14 is integrally moulded about the lifting pin 12.

The void former 14 is substantially concave and comprises a concave inner surface 28, a convex outer surface 30 and a leading edge 32. Two opposed sides of the void former 14 are truncated to form substantially divergent, straight sides 34 and 36, as can be best seen in FIGS. 1 and 3. The concave inner surface 28 of the void former 14 describes a void 38.

The enlarged head 26 of the lifting pin 12 projects from the concave inner surface 28 of the void former 10 into the void 38 defined by the void former 14. The enlarged head 26 does not protrude past the leading edge 32 of the void former 14.

The enlarged foot 24 of the lifting pin 12 projects from the convex outer surface 30 of the void former 14. Integral to the convex outer surface 30 of the void former 14 is a sleeve 40 which substantially covers the portion of the elongate bar 22 of the lifting pin 12 protruding from the convex outer surface 30 of the void former 14, best seen in FIG. 6. The sleeve 40 is formed integrally to the convex outer surface 30 by moulding the void former 14 and sleeve 40 about the lifting pin 12.

The attachment arms 16, 18 and 20 have provided therein slots 42, 44 and 46 respectively. The slots 42, 44 and 46 have provided therein enlarged terminal portions 48, 50 and 52 respectively, offset therefrom best seen in FIGS. 4 and 5. The attachment arms 16, 18 and 20 extend from the void former 14 substantially normal to each other in a plane perpendicular to the orientation of the lifting pin 12 in use. The terminal portions 48, 50 and 52 of the slots 42, 44 and 46, respectively, are proportioned to receive therein cross-members of concrete reinforcing mesh 54, described hereinafter.

The concrete reinforcing mesh 54 comprises in part, reinforcing bars 56, 58 and 60, best seen in FIG. 1. The slots 42, 44 and 46 of the attachment arms 16, 18 and 20, respectively, are positioned therein so as to facilitate press-fitting of the anchoring device 10 to the reinforcing 54, and its retention thereon. The shape of the terminal portions 48, 50 and 52 are complementary to the cross-sectional shape of the reinforcing bars 56, 58 and 60 of the reinforcing mesh 54.

In use, the anchoring device 10 is press-fitted to the reinforcing 54 of a concrete member to be formed. As can be seen in FIG. 1, the terminal portion 48 of the slot 42 of the first attachment arm 16 engages and retains the reinforcing bar 56. The terminal portion 50 of the slot 44 of the second attachment arm 18 engages and retains the reinforcing bar 58. The terminal portion 52 of the slot 46 of the third attachment arm 20 engages and retains the reinforcing bar 60.

The concrete is subsequently poured to form a concrete member of the desired shape, whereby an outer surface of the concrete member is at substantially the same level as the leading edge 32 of the void former 14. The enlarged head 26 of the lifting pin 12 does not protrude past the leading edge 32 of the void former 14. A crane or similar device is able to releasably attach comprising a "pick-up unit" to the enlarged head 26 to allow the concrete member to be moved. The engagement of the terminal portions 48, 50 and 52 of the attachment arms 16, 18 and 20 to the reinforcing bar/mesh serves to distribute shear stress forces into the reinforcing bar/mesh and away from the concrete, thereby substantially preventing the anchoring device 10 from being pulled out of the concrete member.

In one preferred embodiment of the invention, the lifting pin 12 is made of steel and the void former 14 and attachment arms 16,18 and 20 are made of plastic.

While an advantageous and preferred embodiment of the present invention has been selected as an illustration of the invention, it should be understood by those skilled in the art that changes and adaptations can be made therein without departing from the scope of the invention.

What is claimed is:

1. An anchoring device adapted to be partially buried in a concrete member during forming thereof for cooperation with a pick-up unit, the anchoring device comprising a lifting pin and a void former, wherein the void former is integrally molded about the lifting pin, and the void former further comprises a plurality of attachment arms extending outwardly therefrom.

2. An anchoring device according to claim 1, wherein the void former is a substantially hemispherical member comprising a concave inner surface and a convex outer surface such that the concave inner surface defines a substantially hollow void.

3. An anchoring device according to claim 1, wherein the attachment arms comprise slots at their terminal ends.

4. An anchoring device according to claim 1, wherein the attachment arms comprise slots at terminal ends of the attachment arms, and wherein the slots further comprise enlarged terminal portions offset therefrom.

5. An anchoring device according to claim 1, wherein the lifting pin comprises an elongate bar.

6. An anchoring device according to claim 5, wherein the lifting pin further comprises an enlarged foot.

7. An anchoring device according to claim 5, wherein the lifting pin further comprises an enlarged head, the enlarged head projecting into the void formed by the void former.

8. An anchoring device according to claim 1, wherein the void former is integrally molded about the elongate bar of the lifting pin at a position such that the enlarged head of the lifting pin is positioned inside the concave portion of the void former such that the head of the lifting pin does not protrude out of the void formed by the void former.

9. An anchoring device adapted to be partially buried in a concrete member during forming thereof for cooperation with a pick-up unit, the anchoring device comprising a lifting pin and a void former, wherein the void former is integrally molded about the lifting pin, wherein the void former is a substantially hemispherical member comprising a concave inner surface and a convex outer surface such that the concave inner surface defines a substantially hollow void, wherein the lifting pin comprises an elongate bar and wherein the void former between the convex outer surface and an enlarged foot of the lifting pin forms a sleeve about the elongate bar.

10. An anchoring device adapted to be partially buried in a concrete member during forming thereof for cooperation with a pick-up unit, the anchoring device comprising a lifting pin and a void former, wherein the void former is integrally molded about the lifting pin, wherein the void former is a substantially hemispherical member comprising a concave inner surface and a convex outer surface such that the concave inner surface defines a substantially hollow void, wherein the lifting pin comprises an elongate bar and wherein the void former between the convex outer surface and an enlarged foot of the lifting pin forms a sleeve about the elongate bar such that the sleeve is integral to the void former.

11. An anchoring device according to claim 1, wherein the attachment arms comprise slots at their terminal ends, the slots having enlarged terminal portions offset therefrom, wherein the terminal portions of the slots of the attachment arms are adapted to engage reinforcing bar means provided in the concrete member.

* * * * *